US007765622B2

(12) United States Patent
Wiles

(10) Patent No.: US 7,765,622 B2
(45) Date of Patent: Aug. 3, 2010

(54) ADVANCED COMBAT HELMET (ACH) SYSTEM REPLACEMENT PADDING SYSTEM

(76) Inventor: William A. Wiles, 2005 W. Rose Garden La., Phoenix, AZ (US) 85027

( * ) Notice: Subject to any disclaimer, the term of this patent is extended or adjusted under 35 U.S.C. 154(b) by 495 days.

(21) Appl. No.: 11/807,205

(22) Filed: May 26, 2007

(65) Prior Publication Data

US 2009/0222964 A1 Sep. 10, 2009

Related U.S. Application Data

(60) Provisional application No. 60/897,606, filed on Jan. 26, 2007.

(51) Int. Cl.
*A42B 3/00* (2006.01)
*A42B 1/22* (2006.01)
*F41H 1/04* (2006.01)

(52) U.S. Cl. ..... 2/414; 2/410; 2/411; 2/412; 2/413; 2/417; 2/6.6

(58) Field of Classification Search ..... 2/410, 2/411, 412, 413, 414, 415, 416, 417, 418, 2/419, 420, 422, 181, 181.2, 181.4, 181.6, 2/181.8, 182.1, 182.3, 183; D2/865, 866, D2/894; D29/102, 103
See application file for complete search history.

(56) References Cited

U.S. PATENT DOCUMENTS 3,577,562 A * 5/1971 Holt ..... 2/414
3,843,970 A * 10/1974 Marietta et al. ..... 2/415
6,260,205 B1 * 7/2001 Sansarlat ..... 2/181
6,298,483 B1 * 10/2001 Schiebl et al. ..... 2/9
6,389,607 B1 * 5/2002 Wood ..... 2/425
6,883,181 B2 * 4/2005 Long ..... 2/414
6,952,839 B2 * 10/2005 Long ..... 2/414
2002/0010958 A1 * 1/2002 Schiebl et al. ..... 2/413
2002/0152542 A1 * 10/2002 Dennis et al. ..... 2/414
2004/0003452 A1 * 1/2004 Schiebl ..... 2/421
2004/0199981 A1 * 10/2004 Tucker ..... 2/414
2005/0166302 A1 * 8/2005 Dennis ..... 2/414
2005/0183188 A1 * 8/2005 Rudolf et al. ..... 2/414
2005/0251899 A1 * 11/2005 Dennis et al. ..... 2/414
2006/0010568 A1 * 1/2006 Wiles ..... 2/181
2006/0010579 A1 * 1/2006 Wiles ..... 2/410
2006/0096011 A1 * 5/2006 Dennis et al. ..... 2/414
2006/0260026 A1 * 11/2006 Doria et al. ..... 2/414
2006/0277800 A1 * 12/2006 Santos et al. ..... 36/134
2007/0157370 A1 * 7/2007 Joubert Des Ouches ..... 2/410
2007/0163031 A1 * 7/2007 Lewis et al. ..... 2/414
2008/0096001 A1 * 4/2008 Emden et al. ..... 428/222

FOREIGN PATENT DOCUMENTS

JP 3839463 B1 * 11/2006
JP 2008002001 A * 1/2008

* cited by examiner

*Primary Examiner*—Gary L Welch
*Assistant Examiner*—Jane S Yoon
(74) *Attorney, Agent, or Firm*—Donald J Lenkszus

(57) ABSTRACT

A replacement pad kit for use in an Advanced Combat Helmet (ACH) system helmet comprises a plurality of replacement pads for disposition within an ACH helmet. At least one of the replacement pads comprises a fabric layer for contacting the skin of a wearer, an anti-bacterial hydrophilic foam layer, a shock absorption SRF foam layer, and a hook and loop fastener material for engaging some of the plurality of pad receiving hook and loop type fasteners.

25 Claims, 8 Drawing Sheets

ADVANCED COMBAT HELMET (ACH) SYSTEM REPLACEMENT PADDING SYSTEM

RELATED APPLICATIONS

This application claims priority based on U.S. Provisional Application for Patent Ser. No. 60/897,606 filed Jan. 26, 2007.

FIELD OF THE INVENTION

This invention pertains to headwear, in general, and to replacement pads for advanced combat helmets, in particular.

BACKGROUND OF THE INVENTION

The Advanced Combat Helmet (ACH) system currently in use each have a Kevlar or projectile resistant shell that has a number of pads disposed therein. The pads each comprise a visco-elastic high energy absorption foam. One problem with such helmets is that the recommended configurations of two or three pads in the front of the helmet have a gap or gaps through which sweat may drip down onto the face of and into the eyes of the wearer. An additional problem is that after extended wear, the pads smell from bacteria and microbe cultures.

It is highly desirable to provide a cushion that will have the energy absorption properties of the existing pad, prevent dripping of sweat onto the face and into the eyes of the wearer and yet be comfortable and have anti-microbial, anti-bacterial, and/or anti-fungal properties.

SUMMARY OF THE INVENTION

A replacement pad kit for use in an Advanced Combat Helmet (ACH) system helmet in accordance with the invention includes a plurality of replacement pads for disposition within an ACH helmet. At least one of the replacement pads comprises a fabric layer for contacting the skin of a wearer, a hydrophilic foam layer, a shock absorption SRF (slow recovery foam) foam layer, and a hook and loop fastener material for engaging some of said plurality of pad receiving hook and loop type fasteners.

In accordance with one aspect of the invention, at least one pad is elongated so as to extend along the front edge of said ACH helmet substantially from a first location proximate one ear of a wearer to a second location proximate the other ear of the wearer.

Still further in accordance with the principles of the invention, the plurality of replacement pads includes a substantially circular crown pad; and a second pad substantially the same as said brow band pad for fastening in the rear of said ACH helmet along the rear edge.

BRIEF DESCRIPTION OF THE DRAWING

The invention will be better understood from a reading of the following detailed description of preferred embodiments of the invention in conjunction with the drawing figures in which the sizes of and distances between various elements is not representative of actual physical sizes or distances between various elements, and in which.

DETAILED DESCRIPTION

Figure 1B:
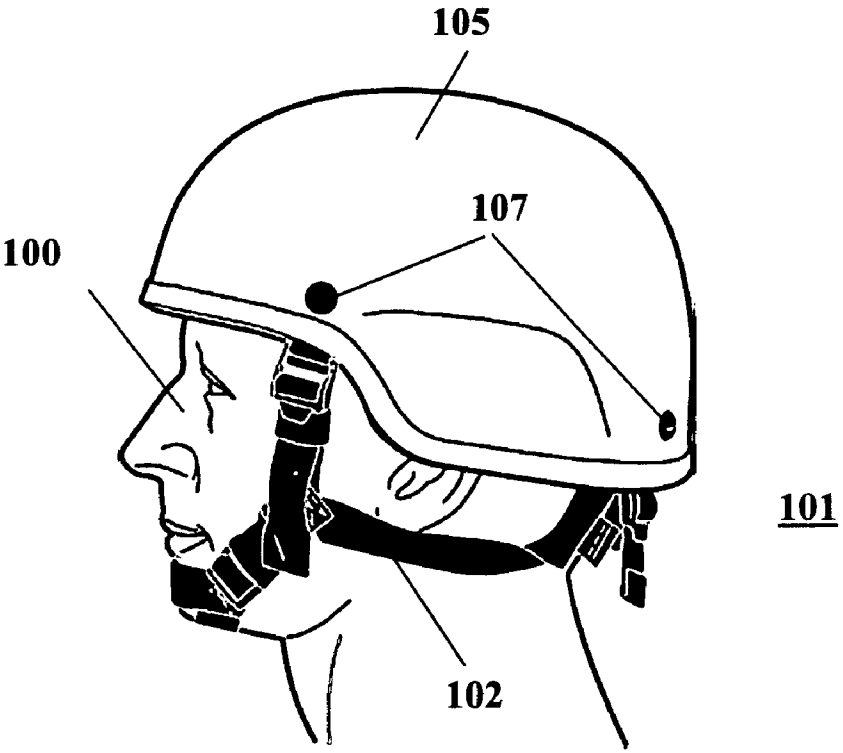
FIGS. 1A and 1B are front and side planar views of an ACH system helmet of the type to which the present invention is advantageously applied.
Figure 1A:
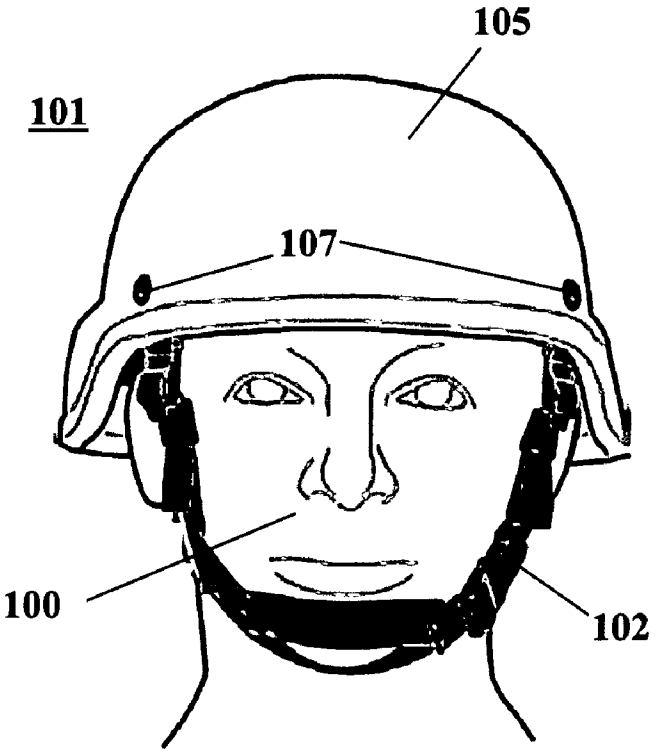
Figure 2:
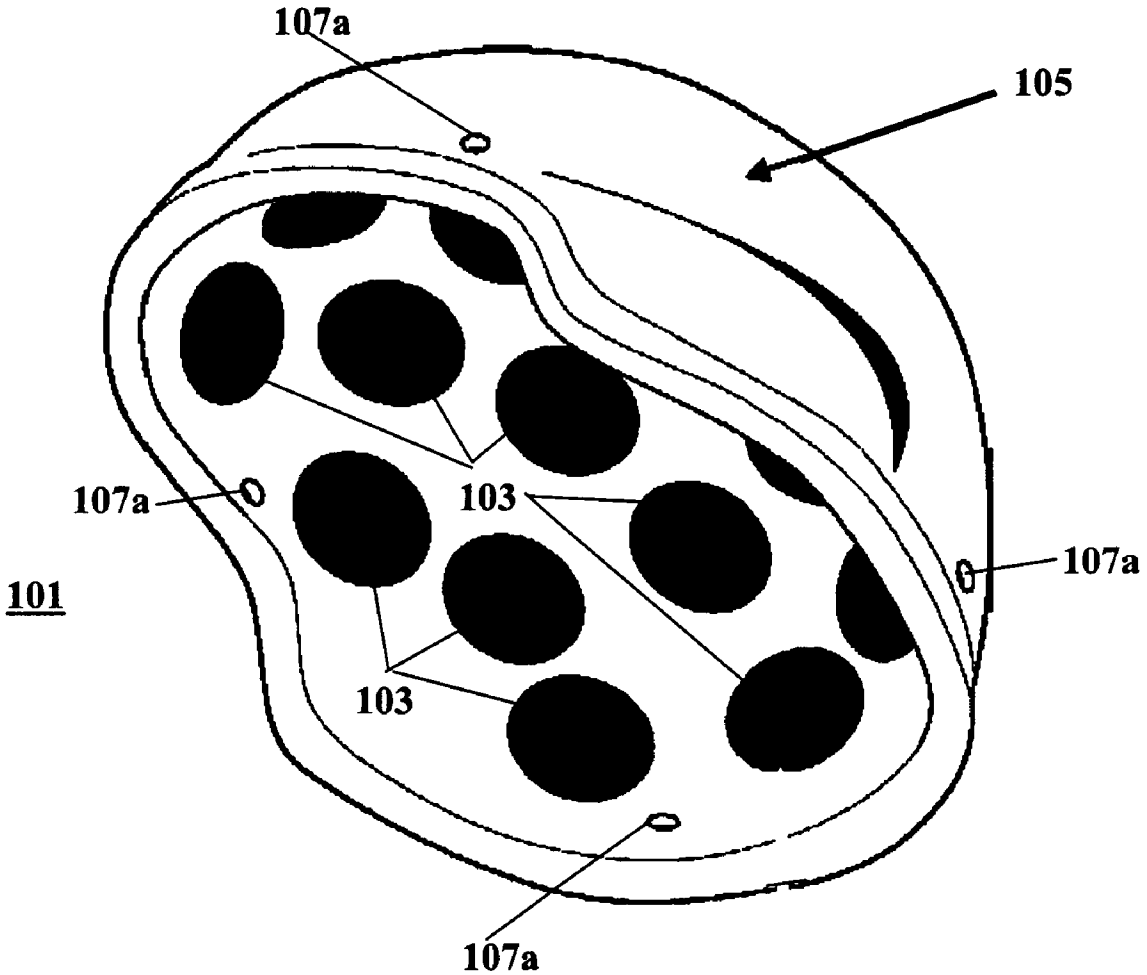
FIG. 2 is a bottom perspective view of an ACH system helmet shell without any pads and showing Velcro hook fasteners.
Figure 3:
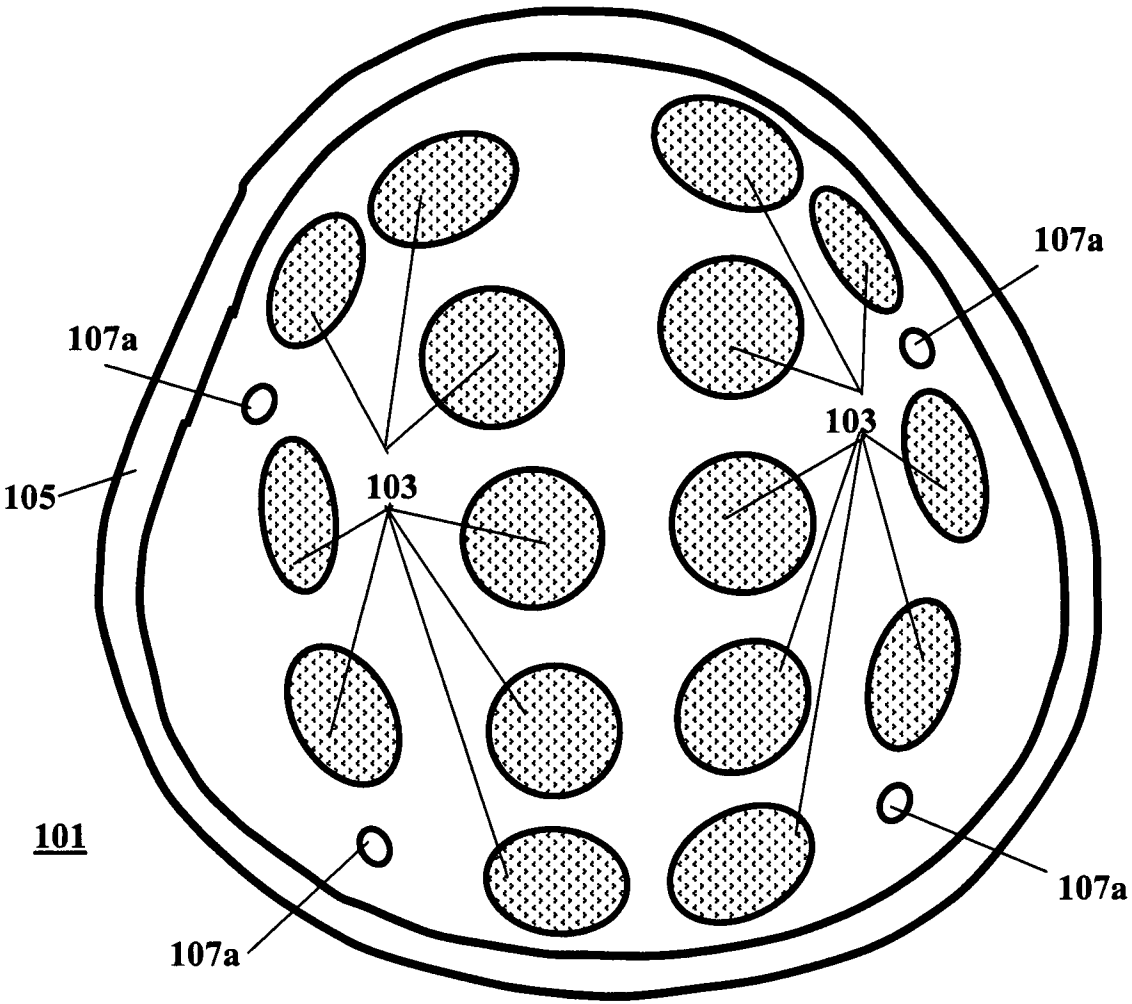
FIG. 3 is a bottom view of the ACH system helmet shell of FIG. 2 showing the location of the Velcro hook fasteners.

FIGS. 1A and 1B show a representative Advanced Combat Helmet (ACH) system helmet 101 on a wearer 100. Technical Manual™ 10-8470-204-10, Operator's Manual for Advanced Combat Helmet, Headquarters, Department of the Army, 31 May 2004 fully describes the ACH helmet. The entirety of the Technical Manual is incorporated herein by reference. Helmet 101 includes a protective helmet body 105 and a strap arrangement 102. Strap arrangement 102 is affixed to helmet body 105 via fasteners 107 that are secured in apertures 107*a* that are more clearly seen in FIGS. 2 and 3. Velcro™ type hook fasteners 103 are disposed on the inside surface of helmet body 105.

The prior ACH helmets utilize a series of pads that have Velcro™ type fabric on the back side so that they may be releasably positioned in helmet 101. The pads in the ACH kit include a crown pad 401 and oblong pads 403.

Figure 4:
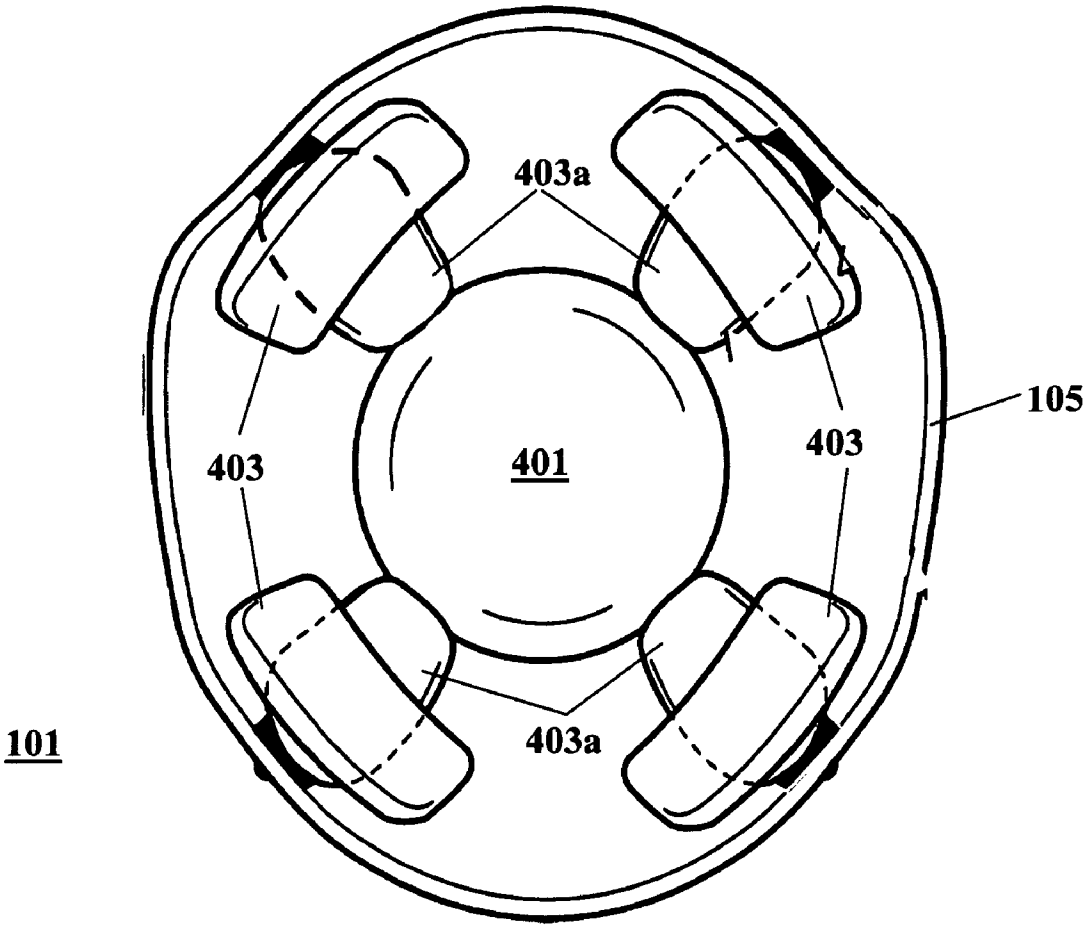
FIG. 4 is a bottom view of the ACH system helmet without straps and illustrating the use of prior art cushion configurations for hot climates.

Turning now to FIG. 4, two recommended configurations for installation of pads are shown. In one configuration, pads 403 are disposed within helmet body 105 with the length of the pads 403 positioned along circumferences of helmet body 105. In a second configuration, the pads, indicated as pads 403*a* are disposed such that the length of the pads extends radially outward from crown cushion 401. Although not shown in FIG. 4 the pads 401, 403 are affixed within the helmet body by the Velcro™ type hook fasteners 103 carried on the inside of helmet body 105. The back of each pad 401, 403 is covered with Velcro™ type loop fasteners.

Both prior recommended configurations position pads 403 to cover fasteners 107.

The recommended use of pads 403 in ACH helmets has pads 403 positioned in the front of the helmet body 105. One problem with this configuration is that sweat can and does drip down the front of the wearer's face. The pads that are supplied with the helmet each utilize commercially available visco-elastic high energy absorption foam that is covered with a rubberized layer. As noted above, after extended wear, the pads smell from bacteria and microbe cultures.

I have developed an improved pad arrangement for use in ACH helmets. This improved pad arrangement may be used as a replacement pad system for use with ACH helmets. This replacement pad arrangement stops the sweat from running into the eyes of a wearer or down the back of a wearer's neck. The replacement pad arrangement of my invention also provides relief from the "pressure points" discomfort caused by the standard issue ACH padding system.

Figure 5B:
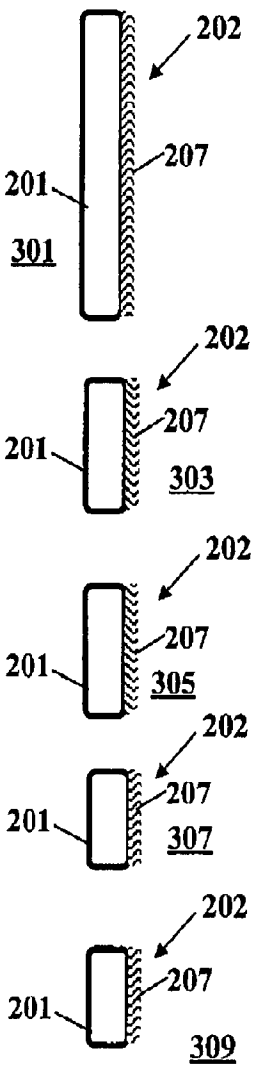
FIG. 5B shows planar end views of each of the pads or cushions of FIG. 5A.
Figure 5A:
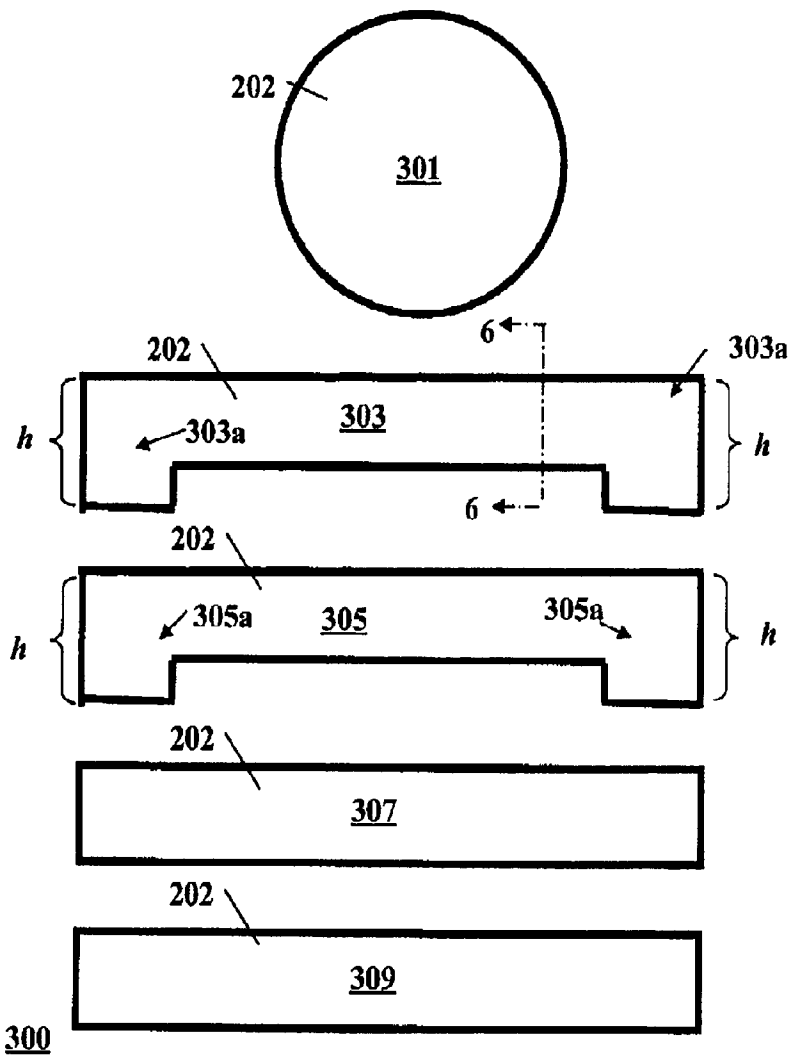
FIG. 5A shows planar views of each of the pads or cushions in accordance with the principles of the invention.

Pads 202 in accordance with my invention are shown in FIGS. 5A and 5B. A complete kit 300 of pads 202 includes a crown pad 301 and four elongate pads 303, 305, 307, 309. Each elongate pad 303, 305 is of a length such that when disposed circumferentially within a helmet body 105, a pair of fasteners 107 is covered and cushioned. Each of elongate pads 303, 305 has at least portions 303*a*, 305*a* having a height "h" selected such that when the pad 303, 305 is positioned proximate the bottom of the helmet the portions 303*a*, 305*a* extend over and fully cover fasteners 107. Although pads 303, 305 are shown as having portions 303*a*, 305*a* that extend further in height than the remaining portion of the pads 303, 305, in other embodiments, the entirety of each pad 303, 305 may have a substantially uniform height "h" that is selected to extend further in height than the fasteners 107 distance from the bottom edge of helmet body 105. Pads 307, 309 are selected to be of the same height.

Figure 6:
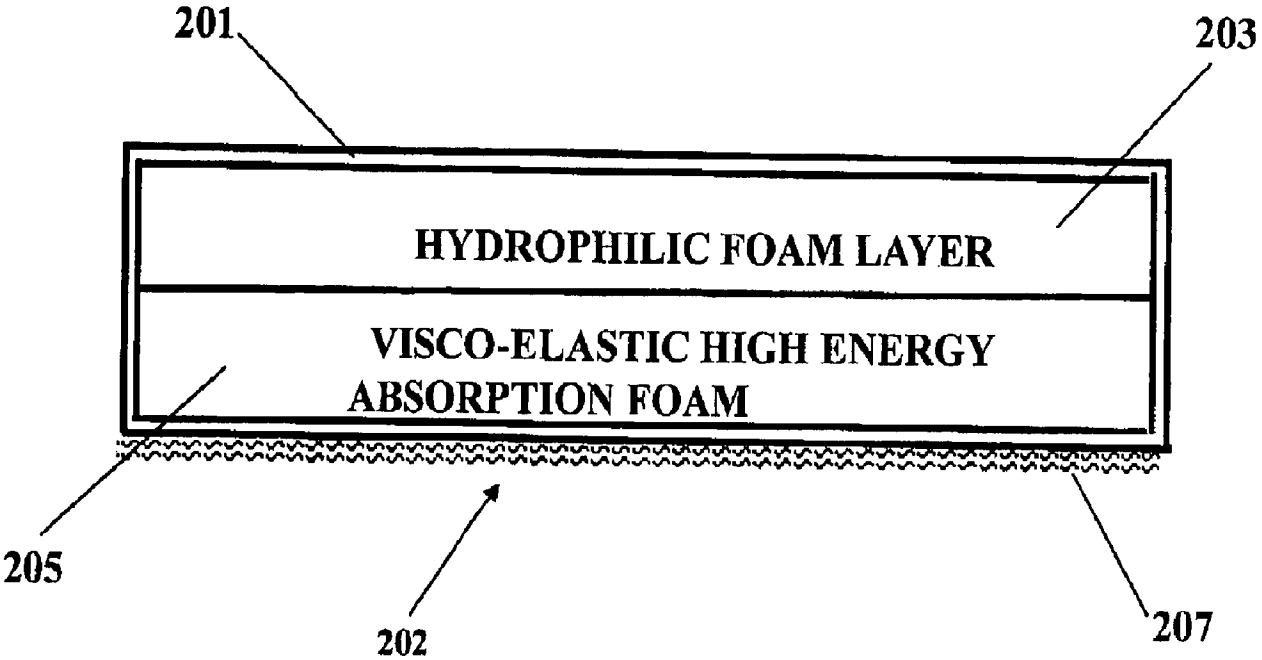
FIG. 6 is a cross-section view of one of the pads shown in FIGS. 5A and 5B taken along the cross-section lines 6-6 shown in FIG. 5*a;*

Each pad 301, 303, 305, 307, 309 comprises four layers as best seem in FIG. 6. Layer 201 that touches the wearer's skin is a fabric that may be a cotton fabric, or another fabric such as silky smooth DuPont Coolmax Dacron polyester fabric engineered to pull sweat away from the skin, through the fabric, and into the second layer 203 that is a commercially available hydrophilic foam layer.

Second layer 203 is an anti-microbial Microbisoft hydrophilic foam layer. This thick "breathable" thick medical grade foam with embedded polymer features high moisture vapor transmission and absorption. The moisture collected by layer 203 is dissipated by evaporation and provides additional cooling. Layer 203 includes controlled release Silver-ion technology to provide anti-bacterial and anti-fungal protection to reduce odors and skin irritation.

A third layer 205 is a Shock Absorption SRF Foam. Foam layer 205 is "welded" to the hydrophilic foam layer 203. This Visco-Elastic high energy absorption foam has been specially formulated to maximize unique slow recovery or "Memory" effects. This foam's exceptional combination of impact energy absorption and visco-elastic recovery imparts unparalleled dampening and anti-vibrational characteristics. Key foam properties such as density (100-300 kg/m3), cell structure, recovery rates and stiffness have been tailored toward this special application.

The fourth layer 205 is disposed on the helmet engaging surface 202 and comprises Velcro™ type "loop" fastener material which attaches the pads to helmet body 105 which has Velcro™ type "hook" disks 103 applied to the inside of the helmet 101.

In summary, in the illustrative embodiment, each pad comprises four parts to each pad. A first layer 201 is DuPont Coolmax fabric which wicks away the sweat into the second layer 203 made of hydrophilic foam. The second layer 203 is "welded to the third layer 205 which is a Visco-Elastic high energy absorption foam and is an impact absorbing foam. And the fourth layer 207 is "loop" fastener fabric which attaches the pads to the "hook" fastener patches 103 on the inside of the helmet body 105.

Five pads 301, 303, 305, 307, 309 are provided in the system. Four pads 303, 305, 307, 309 are substantially rectangular in shape and one pad 301 is circular in shape. Two of the rectangular pads 303, 305 have a wider portion section 303*a*, 305*a* on each end in order to better cover the protruding hardware on the inside of the helmet and better protect the wearer. Alternatively, the pads 303, 305 may be of substantially uniform width along the entire length of the pad, with the width being selected to cover the various fastener rivets or fasteners that may protrude into the interior of helmet 101. Yet further, the pads 303, 305 may be not of rectangular shape, as long as the pads 303, 305 are elongated to traverse the forehead portion of the helmet 101 in one continuous portion. The pads 303, 305 preferably are wide enough at the ends so as to cover any rivets or fasteners that extend into the interior of the helmet 101

Figure 7:
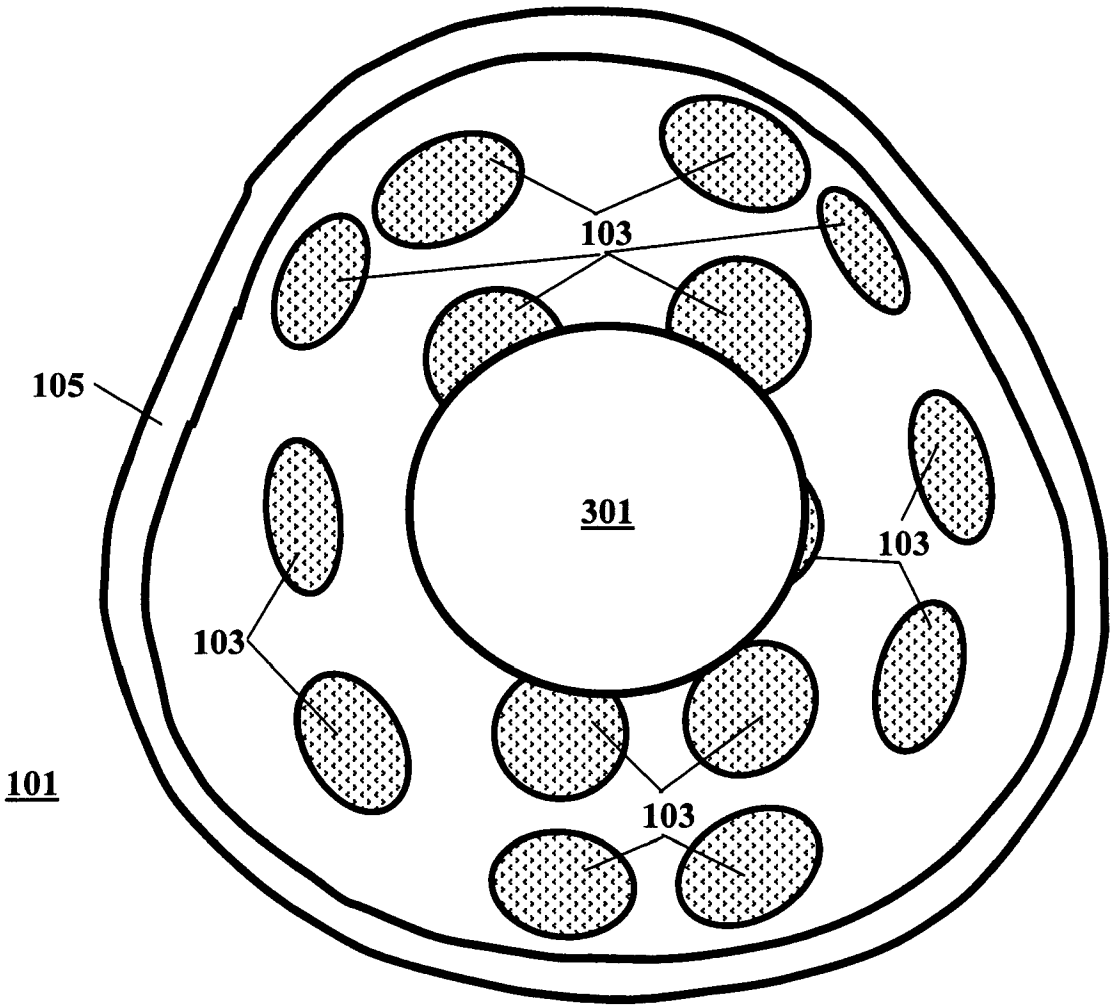
FIG. 7 is a bottom planar view of an ACH helmet with the crown cushion of FIGS. 5A and 5B disposed within the helmet.
Figure 8:
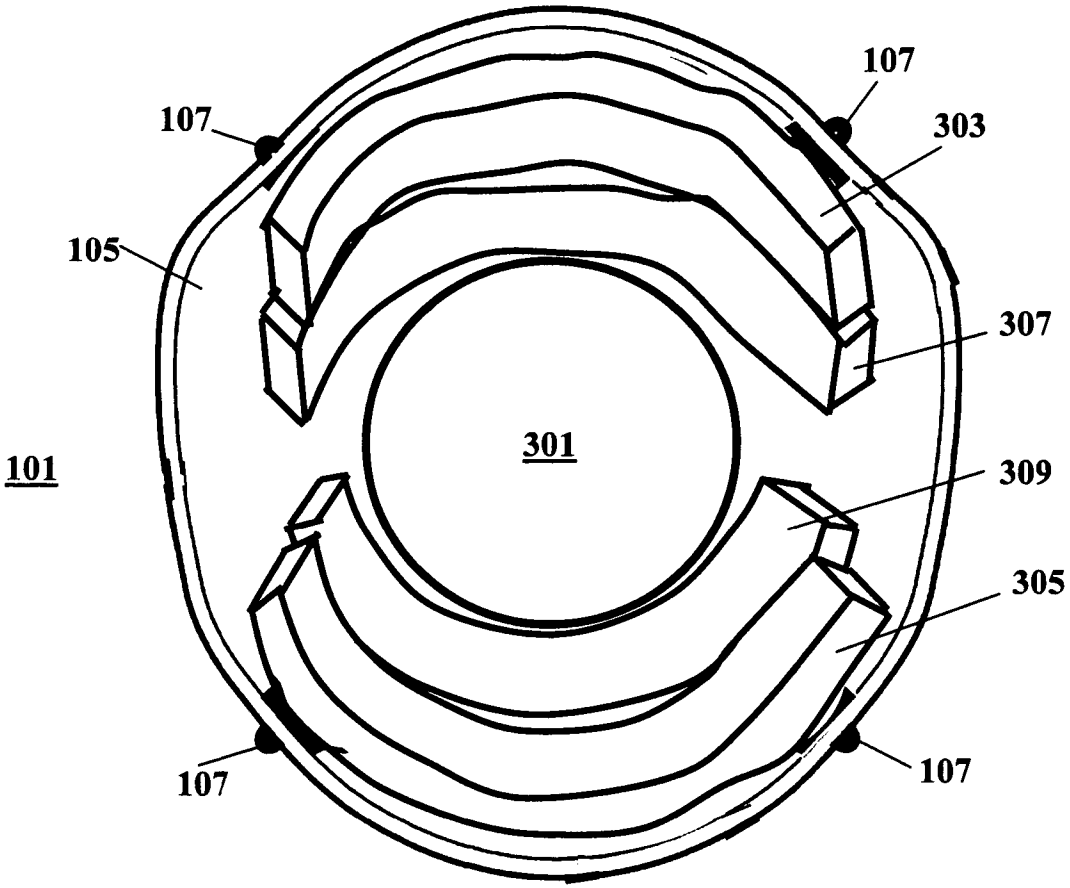
FIG. 8 is a bottom planar view of the helmet of the ACH helmet of FIG. 7 with all the cushions or pads of FIGS. 5*a* and 5B disposed within the helmet.

Circular crown pad 301 goes in the top inside of helmet body 105 as seen in FIGS. 7 and 8. Pad 301 cushions the top of the wearers head. Two rectangular pads 303, 305 with the wide ends go in the front and back of the helmet body 105. They follow along the edge of the helmet body 105. Pad 303 in the front of helmet body 105 becomes a brow band and goes from ear to ear. It prevents sweat from running down the forehead and into the wearer's eyes. Pad 305 goes around the back of helmet body 105. The two remaining rectangular pads 307, 309 fill the gaps between the circular pad 301 and brow pad 303 and the back pad 305.

The invention has been described in terms of an illustrative embodiment. As those skilled in the art will appreciate, various changes and modifications may be made to the embodiment shown without departing from the spirit or scope of the invention. It is not intended that the invention be limited by the specific embodiment shown.

What is claimed is:

1. An Advanced Combat Helmet (ACH) system helmet having a plurality of pad receiving hook and loop type fasteners of either hook type or loop type, comprising:

an ACH helmet body having a plurality of said hook and loop type fasteners disposed at predetermined locations therein, said helmet having a first portion extending over the forehead of a wearer and a rear portion extending lower on the head of a wearer to protect the sides and rear of the head of a wearer, said helmet body rear portion comprising first and second ear protecting portions;

at least one elongate pad disposed within said ACH helmet body;

said at least one pad having a length such that when said pad is disposed in an ACH helmet said pad extends continuously between said first and second ear protecting portions from a location adjacent one ear to a second location adjacent the other ear of a wearer, said at least one pad comprises a fabric layer to contact the skin of a wearer, an anti-bacterial hydrophilic foam layer comprising a single undivided piece extending continuously over said length, a shock absorption SRF foam layer comprising a single undivided piece extending continuously over said length, and a hook and loop fastener material layer to engage some of said plurality of pad receiving hook and loop type fasteners, said at least one pad being constructed such that it is of uniform uninterrupted thickness along its entire length.

2. A replacement pad kit for use in an Advanced Combat Helmet (ACH) system helmet, said helmet comprising a protective shell, said shell comprising a plurality of hook and loop type fasteners disposed at predetermined locations therein, said helmet having a first portion extending over the forehead of a wearer and a rear portion extending lower on the head of a wearer to protect the sides and rear of the head of a wearer, said rear portion comprising first and second ear portions each disposed over and protecting the ears of a wearer of said helmet when said helmet is worn, said kit comprising:

at least one replacement pad comprising a fabric layer for contacting the skin of a wearer, an anti-bacterial hydrophilic foam layer, a shock absorption SRF foam layer, and a hook and loop fastener material to engage some of said plurality of pad receiving hook and loop type fasteners in an ACH helmet; said at least one replacement pad is elongated and having a length so as to extend continuously along the front edge of said ACH helmet front portion from a first location adjacent to one ear of a wearer of an ACH helmet to a second location adjacent to the other ear of said wearer, at least one of said anti-bacterial hydrophilic foam layer and said shock absorption SRF foam layer being a single undivided piece extending continuous over substantially the entirety of said length such that when said one replacement pad is disposed within an ACH helmet said replacement pad provides an uninterrupted layer of uniform thickness along the entirety of said length such that sweat is blocked from running down the face of said wearer between the ears of said wearer.

3. A replacement pad kit for use in an Advanced Combat Helmet (ACH) helmet, comprising:

a plurality of unitary replacement pads for disposition within an ACH helmet, said helmet comprising a protective shell, said shell comprising a plurality of pad fasteners of the hook and loop type disposed at predetermined locations therein, said helmet having a first portion extending over the forehead of a wearer and a rear portion extending lower on the head of a wearer to protect the sides and rear of the head of a wearer;

each of said replacement pads being independently placeable within said ACH helmet;

said plurality of replacement pads comprising a first pad independently fastenable within an ACH helmet as a brow band; and said first pad being elongate and having a length such that when said pad is disposed in an ACH helmet said first pad extends continuously with a uniform uninterrupted thickness within said first helmet portion between said first and second ears of a wearer such that said first pad extends within said helmet from one ear to the other ear of a wearer of said helmet, said first pad comprising: a fabric layer extending continuously along said length to contact the forehead of a wearer continuously from ear to ear, a single undivided piece continuous anti-bacterial hydrophilic foam layer extending without interruption along the entirety of said length behind said fabric layer, and a hook and loop fastener material for engaging some of said plurality of fasteners in said helmet to affix said first pad in position in said helmet, said first pad extending with uniform thickness such that it is configured to block sweat from the head of a wearer of said ACH helmet from running down the face of the wearer between the wearer's ears.

4. A replacement pad kit in accordance with claim 3, wherein:

said plurality of replacement pads comprises a second pad fastenable in an ACH helmet along the rear edge of said ACH helmet, said second pad being elongate and having a second length such that when said second pad is disposed in an ACH helmet said second pad extends continuously in an ACH helmet such that said second pad extends within said helmet from one ear to the other ear along the back of the head of a wearer of said helmet, said second pad comprising a fabric layer extending continuously along said length to contact the wearer continuously from ear to ear, a continuous single undivided piece foam layer extending uninterrupted along the entirety of said second length, and a hook and loop fastener material for engaging some of said plurality of fasteners in said helmet to affix said second pad in position in said helmet, said second pad extending with uniform thickness such that it is configured to block sweat from running down the neck of the wearer.

5. A replacement pad kit in accordance with claim 4, wherein:

said plurality of replacement pads comprising a substantially circular crown pad.

6. A replacement pad kit in accordance with claim 5, comprising:

said plurality of replacement pads comprising a third elongate pad for disposition in an ACH helmet intermediate and independent of said crown pad and said brow band pad; and said plurality of replacement pads comprising a fourth elongate pad for disposition in an ACH helmet intermediate and independent of said crown pad and said second pad.

7. A replacement pad kit in accordance with claim 6, wherein:

each said pad of said plurality of replacement pads comprises a fabric layer for contacting the wearer, a continuos single undivided piece shock absorption SRF foam layer, and a hook and loop fastener material for engaging some of said plurality of fasteners.

8. A replacement pad kit in accordance with claim 7, wherein:

each said pad of said plurality of replacement pads comprises a hydrophilic foam layer.

9. A replacement pad kit in accordance with claim 8, wherein:

each said hydrophilic foam layer is anti-bacterial.

10. A replacement pad kit in accordance with claim 4, wherein:

each said pad of said plurality of replacement pads comprises a fabric layer to contact the wearer, a continuous single undivided piece shock absorption SRF foam layer, and a hook and loop fastener material for engaging some of said fasteners.

11. A replacement pad kit in accordance with claim 10, wherein:

each said pad of said plurality of replacement pads comprises a hydrophilic foam layer.

12. A replacement pad kit in accordance with claim 11, wherein:

said hydrophilic foam layer is anti-bacterial.

13. A replacement pad kit in accordance with claim 3, wherein:

each pad of said plurality of replacement pads comprises a fabric layer to contact the wearer, a continuous single undivided piece shock absorption SRF foam layer, and a hook and loop fastener material for engaging some of said plurality of fasteners.

14. A replacement pad kit in accordance with claim 13, comprising:

each said pad of said plurality of replacement pads comprises an anti-bacterial hydrophilic foam layer.

15. A replacement pad kit in accordance with claim 3, wherein:

said ACH helmet comprises fasteners extending into the interior of said ACH helmet; and said first pad is configured to cover said fasteners extending into the interior of said ACH helmet.

16. An Advanced Combat Helmet (ACH) system helmet having a plurality of pad receiving hook and loop type fasteners of either hook type or loop type, comprising:

an ACH helmet body, said helmet body comprising a protective shell, said shell comprising a plurality of pad fasteners of the hook and loop type disposed at predetermined locations therein, said helmet having a first portion extending over the forehead of a wearer and a rear portion extending lower on the head of a wearer to protect the sides and rear of the head of a wearer;

a plurality of hook and loop type fasteners disposed within said helmet body;

at least one pad disposed within said ACH helmet body;

said at least one pad comprising a first pad fastenable to selected ones of said fasteners within said ACH helmet as a brow band disposed on the inside of said forehead portion; said first pad being elongate and having a length selected to be equal to the distance on the inside of the front of said helmet between areas of said helmet adjacent the ears of a wearer, said pad extending continuously from areas in an ACH helmet immediately adjacent the ears of a wearer to prevent sweat from the head of a wearer of said ACH helmet from running down the face of the wearer, said pad comprising a single undivided piece anti-bacterial hydrophilic foam layer portion extending without interruption continuously over said length.

17. An ACH helmet in accordance with claim 16, comprising:

a substantially circular crown pad; and a second pad independent of said first pad and substantially the same as said first pad for fastening in the rear of said ACH helmet along the rear edge of said ACH helmet, said second pad being elongate and having a second length selected to be substantially equal to the distance in the rear of said helmet between said first and second ear area portions such that when disposed in an ACH helmet said second pad extends continuously from areas in an ACH helmet immediately adjacent the rear of the ears of a wearer, said second pad configured to prevent sweat from the head of a wearer of an ACH helmet from running down the neck of the wearer.

18. An ACH helmet in accordance with claim 17, comprising:

a third elongate pad independent of said first and second pads for disposition in said ACH helmet intermediate said crown pad and said brow band pad; and a fourth elongate pad independent of said first, second and third pads for disposition in said ACH helmet intermediate said crown pad and said second pad.

19. An ACH helmet in accordance with claim 18, wherein:

each of said first, second, third, fourth and crown pads comprises a fabric layer for contacting the skin of a wearer, a continuous single undivided piece shock absorption SRF foam layer, and a hook and loop fastener material for engaging said pad receiving hook and loop type fasteners.

20. An ACH helmet in accordance with claim 19, comprising:

each of said first, second, third, fourth and crown pads each comprises a hydrophilic foam layer.

21. An ACH helmet in accordance with claim 19, comprising:

each of said first, second, third, fourth and crown pads each comprises an anti-bacterial hydrophilic foam layer.

22. An ACH helmet in accordance with claim 17, wherein:

said first, second and crown pads each comprises a fabric layer for contacting the skin of a wearer, a continuous single undivided piece shock absorption SRF foam layer, and a hook and loop fastener material for engaging some of said plurality of pad receiving hook and loop type fasteners.

23. An ACH helmet in accordance with claim 22, comprising:

each of said first, second, and crown pads comprises an anti-bacterial hydrophilic foam layer.

24. An ACH helmet in accordance with claim 16, wherein:

said first pad comprises a fabric layer for contacting the skin of a wearer, a continuous single undivided piece uninterrupted shock absorption SRF foam layer, and a hook and loop fastener material for engaging some of said plurality of pad receiving hook and loop type fasteners.

25. An ACH helmet in accordance with claim 16, comprising:

said first pad is configured to cover fasteners extending into the interior of said ACH helmet.

* * * * *